US005689782A

United States Patent [19]

Murakami et al.

[11] Patent Number: 5,689,782

[45] Date of Patent: Nov. 18, 1997

[54] DEVELOPING APPARATUS FOR ELECTRONIC PHOTOGRAPHIC RECORDING EQUIPMENT, HAVING TWO DEVELOPER TRANSFER ROLLERS

[75] Inventors: Eisaku Murakami, Hiratsuka; Kazuhiro Yuasa, Zama; Shuichi Endoh, Isehara; Iwao Matsumae, Musashino; Yoshiaki Tanaka, Kawasaki; Hiroshi Hosokawa, Yokohama; Mugiziroh Uno, Isehara; Hiroshi Saitoh, Ayase; Eizi Takenaka, Isehara; Toshihiro Sugiyama, Atsugi; Tetsuo Yamanaka, Tokyo-to; Satoru Komatsubara, Atsugi, all of Japan

[73] Assignee: Ricoh Company, Ltd., Tokyo, Japan

[21] Appl. No.: 485,772

[22] Filed: Jun. 7, 1995

[30] Foreign Application Priority Data

Jun. 8, 1994 [JP] Japan ..... 6-126458

[51] Int. Cl.[6] ..... G06G 15/08

[52] U.S. Cl. ..... 399/281; 399/272; 399/285

[58] Field of Search ..... 355/245, 251, 355/253, 254, 255, 259, 260; 118/651, 653, 655–658, 661; 399/260, 226, 267, 277, 270, 274, 282, 281, 285, 272

[56] References Cited

U.S. PATENT DOCUMENTS

| | | | |
|---|---|---|---|
| 4,370,049 | 1/1983 | Kuge et al. | 399/274 X |
| 4,537,491 | 8/1985 | Komada et al. | 118/658 X |
| 4,580,121 | 4/1986 | Ogawa | 355/251 X |
| 4,637,708 | 1/1987 | Yuasa . | |
| 4,656,964 | 4/1987 | Kanno et al. | 355/251 X |
| 5,126,799 | 6/1992 | Matsuura et al. | 355/298 |
| 5,212,521 | 5/1993 | Ogawa et al. | 355/215 |
| 5,223,668 | 6/1993 | Takaya et al. | 118/651 |
| 5,286,917 | 2/1994 | Unno et al. | 355/245 X |
| 5,287,151 | 2/1994 | Sugiyama | 355/260 |
| 5,289,241 | 2/1994 | Sugiyama et al. | 355/260 |
| 5,315,357 | 5/1994 | Kamijo et al. | 355/298 |
| 5,333,040 | 7/1994 | Imamiya | 355/245 X |
| 5,337,124 | 8/1994 | Schmidlin et al. | 399/282 |
| 5,389,733 | 2/1995 | Enoki et al. | 118/657 |
| 5,486,909 | 1/1996 | Takenaka et al. | 399/274 |
| 5,489,747 | 2/1996 | Takenaka et al. | 399/274 X |

FOREIGN PATENT DOCUMENTS 0 572 997 A2 12/1993 European Pat. Off. .

*Primary Examiner*—S. Lee

*Attorney, Agent, or Firm*—Oblon, Spivak, McClelland, Maier & Neustadt, P.C.

[57] ABSTRACT

A developing apparatus is capable of providing stable charging ability for a developer and stable transfer ability for transferring the developer to a photoreceptor for electronic photography to prevent residual positive images and stain of texture which appear on a toner image. A first toner transfer roller 23 has a core supported to be rotatable and a sheet type insulation layer wound around the outer periphery of the core. The insulation layer is made of elastic rubber in which magnetic material having a specified particle size is uniformly dispersed and the magnetic material is formed with ferromagnetic substance such as magnet and magnetized in advance. The first toner transfer roller 23 attracts toner T by actuating magnetism on the insulation layer since the magnetic material added to the insulation layer is magnetized.

10 Claims, 3 Drawing Sheets

DEVELOPING APPARATUS FOR ELECTRONIC PHOTOGRAPHIC RECORDING EQUIPMENT, HAVING TWO DEVELOPER TRANSFER ROLLERS

BACKGROUND OF THE INVENTION

1. Field of the Invention

The present invention relates to a developing apparatus to be applied to electronic photographic recording equipment such as, for example, facsimile machines, copiers and printers.

2. Related Background Art

FIG. 8 shows a schematic configuration of an electronic photographic recording equipment to which a developing apparatus which is the base of the present invention is applied. Though the developing apparatus 10 shown in FIG. 8 is known to the applicant of the present invention, it remains yet generally unknown. 1 is a photoreceptor drum. 2 is a charging roller, 3 is a transfer roller, 10 is a developing apparatus using a two-stage developing system, 11 is a toner reservoir, which stores toner T which is a one-component developer, provided in the developing apparatus, 12 is an agitator for agitating the toner T in the toner reservoir, 13 is a first toner transfer roller which is a first developer transfer means, 14 is a second toner transfer roller such as a second developer transfer means, and 15 is a charging blade which is a developer control means.

A static latent image is formed with a laser beam on the photoreceptor drum 1 which is uniformly charged by the charging roller 2. The developing apparatus 10 develops the static latent image to a toner image by transferring the toner T onto the photoreceptor drum 1. This static latent image is electrostatically transferred from the photoreceptor drum i onto a recording paper P by the transfer roller 3 and the transferred static latent image is fixed on the recording paper P by a fixing apparatus, not shown.

In development by the developing apparatus, a bias voltage F1 from a transfer bias power supply 4 is applied to the first toner transfer roller 13 and the charging blade 15 and a bias voltage F2 from a development bias power supply 5 is applied to the second toner transfer roller 14. The first toner transfer roller 13 is provided with a magnet on its surface layer part to attract toner T, which has been agitated by the agitator 12 in the toner reservoir 11, to the surface of the toner transfer roller 13 by magnetization. The charging blade 15 slides to contact the toner T which remains on the first toner transfer roller 13 to thin the layer of the toner T and charge the toner T by friction.

The second toner transfer roller 14 is formed with an elastic layer 14*a* the surface of which has an elasticity and kept in contact under pressure with the first toner transfer roller 13. The toner T which has been charged by friction on the first toner transfer roller 13 is transferred onto the second toner transfer roller by a static electricity produced due to a potential difference between the bias voltage F1 and the bias voltage F2 at a position where the first toner transfer roller 13 comes in contact with the second toner transfer roller 14. The second toner transfer roller 14 selectively transfers the toner T onto one of an exposed area and a non-exposed area on the photoreceptor drum t at the developing position to develop the static latent image on the photoreceptor drum 1 to a toner image.

However, if the first toner transfer roller 13 of the developing apparatus 10 which employs the above-described two-stage developing system does not have a sufficient insulating effect, charging of the toner T on the first toner transfer roller 13 may be unstable and insufficient when the toner T which is insufficiently charged is transferred onto the second toner transfer roller 14, some abnormalities such as residual positive images and stain of texture are observed on the toner image developed with the toner T on the second toner transfer roller 14.

In a case that the surface layer part of the first toner transfer roller 13 is formed with an insulating material to increase the insulation effect of the first toner transfer roller 13, the magnetism of the magnet may be attenuated by the insulating material and the first toner transfer roller 13 may not be fully attract the toner T. Therefore, when the amount of the toner T on the first toner transfer roller 13 is insufficient, there will be caused a problem that the density of the toner image will be insufficient.

In addition, there is a problem that, if the machine is kept stopped for a long period of time, the elastic layer 14*a* creeps at the contact position to cause local deformation due to plasticity and the static latent image cannot be normally developed since the second toner transfer roller 14 is maintained in contact under pressure with the first toner transfer roller 13.

SUMMARY OF THE INVENTION

An object of the present invention is to provide a developing apparatus capable of providing stable charging ability for a developer and a stable transfer ability of the developer for an electronic photographic photoreceptor.

DETAILED DESCRIPTION OF THE PREFERRED EMBODIMENTS

The preferred embodiments of the present invention are described in detail below, referring to the accompanying drawings.

Figure 1:
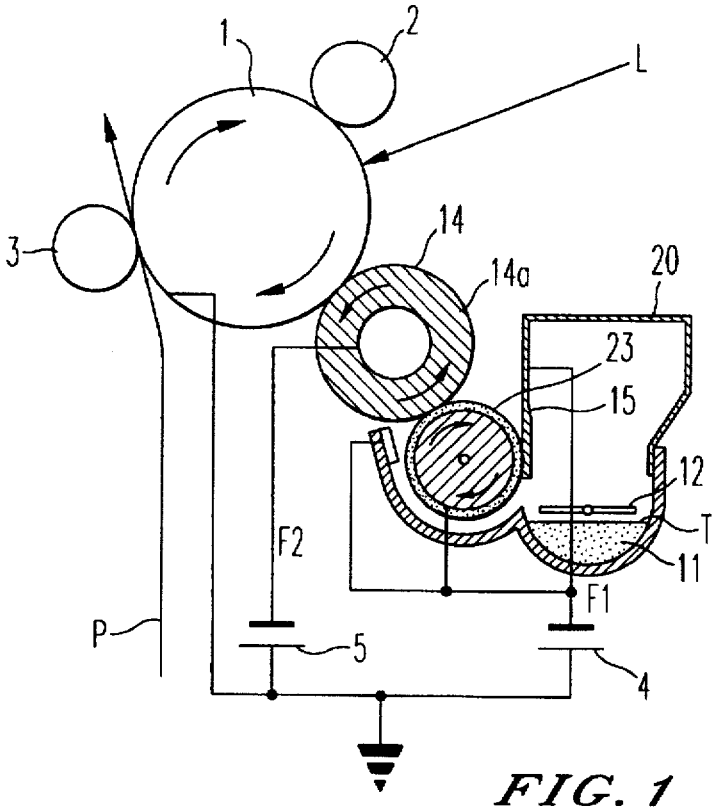
FIG. 1 is a schematic configuration diagram of an electronic photographic recording equipment to which an embodiment of a developing apparatus according to the present invention is applied.
Figure 2:
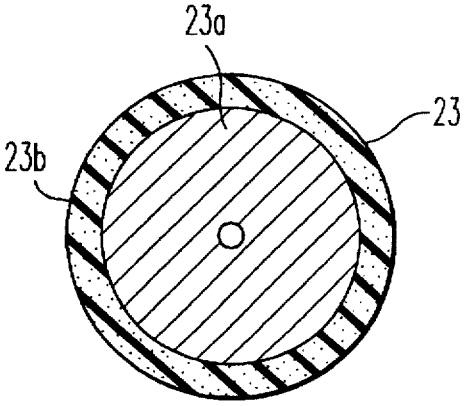
FIG. 2 is a side view showing an example of a first toner transfer roller in an embodiment according to the present invention.
Figure 8:
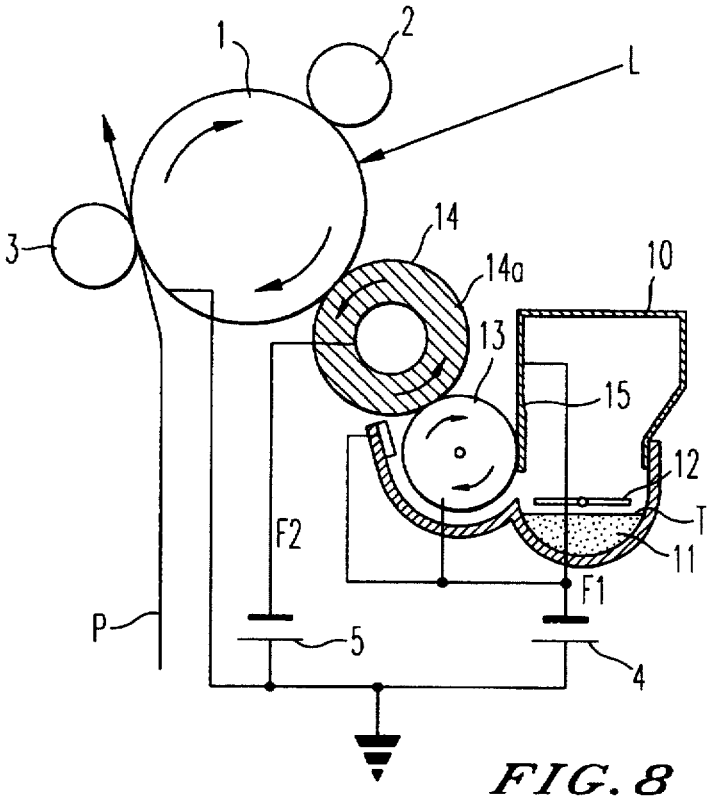
FIG. 8 is a schematic configuration diagram of the electronic photographic recording equipment to which a developing apparatus, which is the base of the present invention, is applied.

FIG. 1 is a schematic configuration diagram of an electronic photographic recording equipment to which an embodiment of a developing apparatus according to the present invention is applied and FIG. 2 is a side view showing an example of a first toner transfer roller in this embodiment, whereby those members corresponding to the members described according to FIG. 8 are given the same reference numerals and the description thereof is omitted.

Reference numerals 20 denote a developing apparatus arranged in the electronic photographic recording equipment and 23 is the first toner transfer roller which is a first developer transfer means of the developing apparatus 20. The first toner transfer roller comprises a core 23*a* which is supported to be rotatable and a sheet type insulation layer which wound around the outer periphery of the core 23*a* as shown in FIG. 2. The insulation layer 23*b* is made of an elastic rubber in which magnetic material having specified particle size is uniformly dispersed and the magnetic material is formed with ferromagnetic substance such as magnet and magnetized in advance.

Generally, a relationship between a bias voltage F1 to be applied to the first toner transfer roller 23 by a transfer power supply 4 and a bias voltage F2 to be applied to a second toner transfer roller 14 by a developing bias power supply 5 is as described below:

In a case the toner is negative-charged for negative-positive development: $F1<F2<0$ In a case the toner is negative-charged for positive-positive development: $0<F1<F2$ In a case the toner is positive-charged for negative-positive development: $0<F2<F1$ In a case the toner is positive-charged for positive-positive development: $F2<F1<0$ In This embodiment, the above relationship in the case that the toner is negative-charged for negative-positive development.

In the developing apparatus 20, the toner T transferred to a position near the first toner transfer roller 23 by an agitator 12 is attracted onto the roller surface of the first toner transfer roller 23 by the magnetism of the insulation layer 23*b*. The first transfer roller 23 which attracts The toner T rotates in the arrow direction and the toner T on the first toner transfer roller 23 is thinned to the specified thickness by the charging blade 15 and friction-charged along with the contact with the charging blade 15.

In this embodiment, since The bias voltages F1 and F2 which are in the relation of $F1<F2<0$ are respectively applied to the toner transfer rollers 23 and 14 in negative-positive development, the normally (negative) charged toner T on the first toner transfer roller 23 is transferred onto the second toner transfer roller 14 by a static transfer force and an attracting force produced from a potential difference between the bias voltages F1 and F2 and to a developing position where the second toner transfer roller 14 comes in contact under pressure with the photoreceptor drum 1. However, the reversely charged toner T contrary to the normally charged toner remains attracted onto the first toner transfer roller 23 and is not transferred to the second toner transfer roller 14 and therefore the reversely charged toner T can be prevented from being transferred to the photoreceptor drum i to cause the stain of the texture. The second toner transfer roller 14 transfers the toner T to the developing position, particularly to an exposure area for the static latent image formed on the photoreceptor drum 1 whereby the static latent image is developed to a toner image. Rotation of the rotating members such as a developing roller 43 and a toner transfer roller 44 is not limited to the directions s shown.

In this embodiment, the bias voltages F1 and F2 are respectively set to approximately a few hundreds volts and the first toner transfer roller 23 and the second toner transfer roller 14 are kept in contact and therefore, when the insulation is insufficient for the bias voltages F1 and F2, there is a risk that the bias voltages F1 and F2 may leak to destroy the equipment. In this embodiment, the insulation layer 23*b* of the first toner transfer roller 23 and the elastic layer 14*a* of the second toner transfer roller 14 are provided with the insulation property to prevent a current from leaking and consequently destroying the equipment when the bias voltages F1 and F2 are applied. Assuming the volume resistance value of the insulation layer 23*b* of the first toner transfer roller 23 as $R_{V1}$ and the volume resistance value of the elastic layer 14*a* of the second toner transfer roller 14 as $R_{V2}$, the materials for the insulation layer 23*b* and the elastic layer 14*a* are respectively selected so that these values appear in $R_{V1}<R_{V2}$ in this embodiment. Such selection prevents the current from leaking through the first toner transfer roller 23 to the second toner transfer roller 14 when the bias voltages F1 and F2 are applied.

The composition of raw materials of the insulation layer 23*b* is adjusted so that the weight percentage of magnetic material is 50 wt % or over and the insulation layer 23*b* is formed so that the thickness is at least 0.3 mm or over. In this case, the upper limit value of the magnetic material to be added to the insulation layer 23*b* is limited by the volume resistance value of the insulation layer 23*b*. Generally, the volume resistance value of the insulation layer 23*b* reduces along with increasing of the weight percentage of magnetic material and therefore, if the magnetic material is excessively added, the insulation property of the insulation layer 23*b* cannot be appropriately maintained. Specifically, the amount of magnetic material to be added to the insulation layer 23*b* can be increased for a reason described below in a range that the volume resistance value of the insulation layer 23*b* is maintained at least higher than $10^5\Omega\cdot$cm. Magnetic material the particle size of which is within the range of $10^{-11}$ m or over and $10^{-4}$ m or under is added to the insulation layer 23*b* to maintain insulation effect and uniformity of the amount of magnetization.

As described above, elastic rubber is used as a material for the base of the insulation layer 23*b* of the first toner transfer roller 23 to permit elastic deformation of the insulation layer 23*b*. Thus, elastic deformation of the insulation layer 23*b* occurs at the position of forced contact with the second toner transfer roller 14 and therefore the elastic layer 14*a* of the second toner transfer roller 14 is prevented from large local deformation and, even when the idling time of the equipment is long, the elastic layer 14*a* is prevented from permanent deformation due to creeping.

Figure 3:
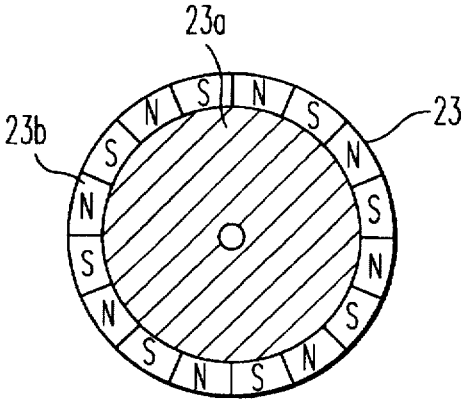
FIG. 3 is an illustration of an insulation layer magnetized in an embodiment according to the present invention.

Since the magnetic material added to the insulation layer 23*b* is magnetized, the insulation layer 23*b* is magnetized so that the N pole and the S pole are alternately arranged in the peripheral direction as shown in FIG. 3 and the toner T can be attracted onto the first toner transfer roller 23 by acting the magnetism with the insulation layer 23*b*. Thus a magnet need not be arranged inside the first toner transfer roller 23 and the magnetism is directly actuated under the condition that the insulation layer 23*b* is kept in contact with the toner T and therefore a stable powerful magnetism can be made act on the toner T.

Figure 5:
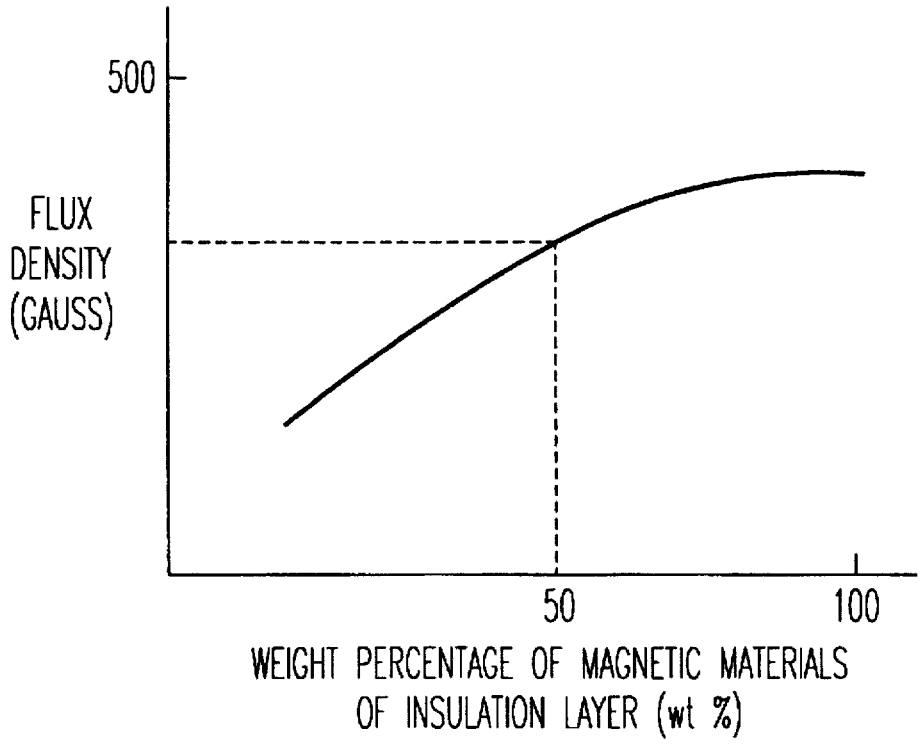
FIG. 5 is a characteristic diagram showing a relationship between content ratios of magnetic materials and flux densities in the insulation layer in an embodiment according to the present invention.

FIG. 5 is a characteristic diagram showing the relationship between the weight percentage of magnetic material and the flux density in the insulation layer of this embodiment. As shown in the diagram, the weight percentage of the magnetic material in the insulation layer 23b is increased and the flux density on the surface of the insulation layer 23b is increased.

In this embodiment, a flux density with which the insulation layer 23b sufficiently attracts the toner T is ensured by setting the weight percentage of the magnetic material to 50 wt % or over. In this case, if the weight percentage of the magnetic material is 50 wt % or under, the quantity of the toner T per unit area to be attracted onto the first toner transfer roller 23 decreases and therefore the rotation rate of the first toner transfer roller 23 should be increased to a high speed to supply a sufficient quantity of the toner T which prevents insufficiency of the density to the second toner transfer roller. However, there is a problem that, if the first toner transfer roller 23 is rotated at a high rate, the charging blade 15 is quickly worn and the toner T melted due to a friction heat at the nip part of the charging blade 15 and the first toner transfer roller 23 adheres to the charging blade 15.

The magnetic material added to the insulation layer 23b is adjusted to have the particle size of $10^{-11}$ m or over and $10^{-4}$ m or under. This means that, if the particle size of magnetic material is coarse and large, it is difficult to uniformly disperse the magnetic material in the insulation layer 23b and the distribution of the resistance and the amount of magnetization in the insulation layer 23b is uneven. On the other hand, if the magnetic material is excessively fine, the surface area of the magnetic material increases and the resistance of the insulation layer 23b reduces and therefore the leak current increases and charging of the toner T is insufficient when the bias voltages F1 and F2 are applied. As a result of an experiment with variations of the particle size of the magnetic material, it is clarified that the above problem can be solved and the static latent image can be developed satisfactorily by setting the particle size of the magnetic material of the insulation layer 23b to the range of $10^{-11}$ m or over and $10^{-4}$ m or under.

Figure 6:
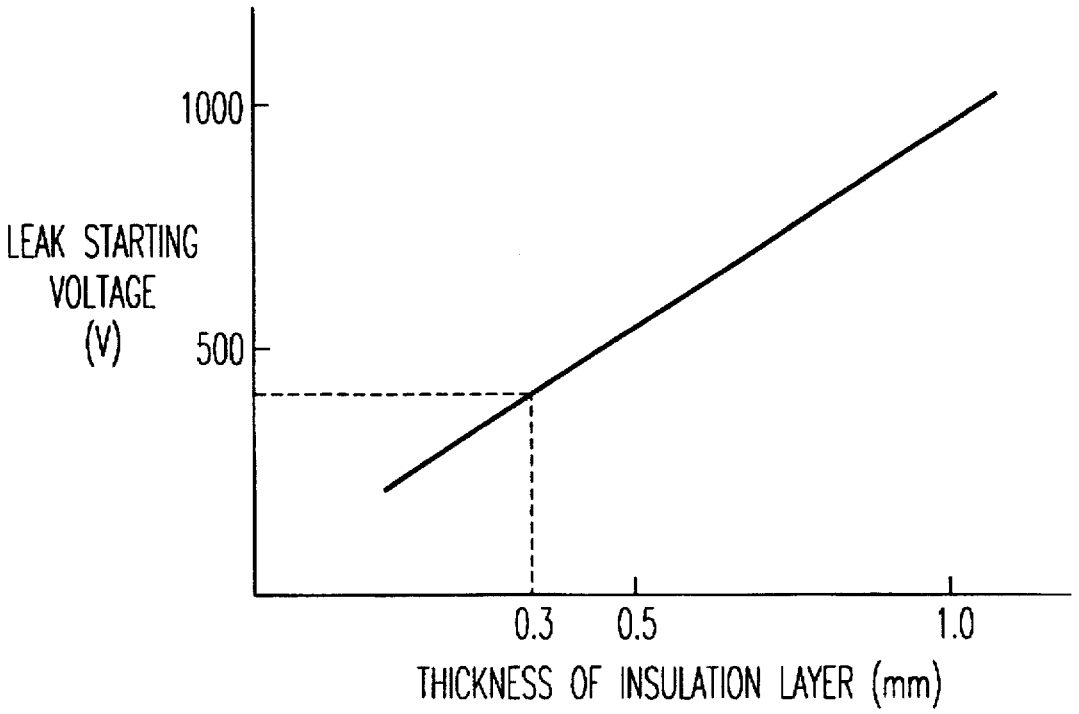
FIG. 6 is a characteristic diagram showing a relationship between a thickness of the insulation layer and a leak starting voltage in the insulation layer in an embodiment according to the present invention.

FIG. 6 is a characteristic diagram showing the relationship between the thickness of the insulation layer and the leak starting voltage in this embodiment. As shown, the leak starting voltage, which is a voltage at which the current supplied to the insulation layer 23b starts leaking, becomes high as the thickness of the insulation layer 23b is increased.

In this embodiment, the insulation layer 23b of the first toner transfer roller 23 is formed with a thickness of at least 0.3 mm. Thus the leak starting voltage in the insulation layer 23b is higher than at least the bias voltage F1 and the bias voltage F1 applied to the first toner transfer roller 23 at the time of development can be prevented and the toner T can be normally charged by friction. In this case, if the thickness of the insulation layer 23b is thinner than 0.3 mm, the leak starting voltage in the first toner transfer roller 23 may be smaller than the bias voltage F1 and the equipment may be damaged with a leak current. In addition, it is difficult to carry out smooth cutting of the insulation layer 23b and the costs of manufacturing the first toner transfer roller 23 increase.

Figure 7:
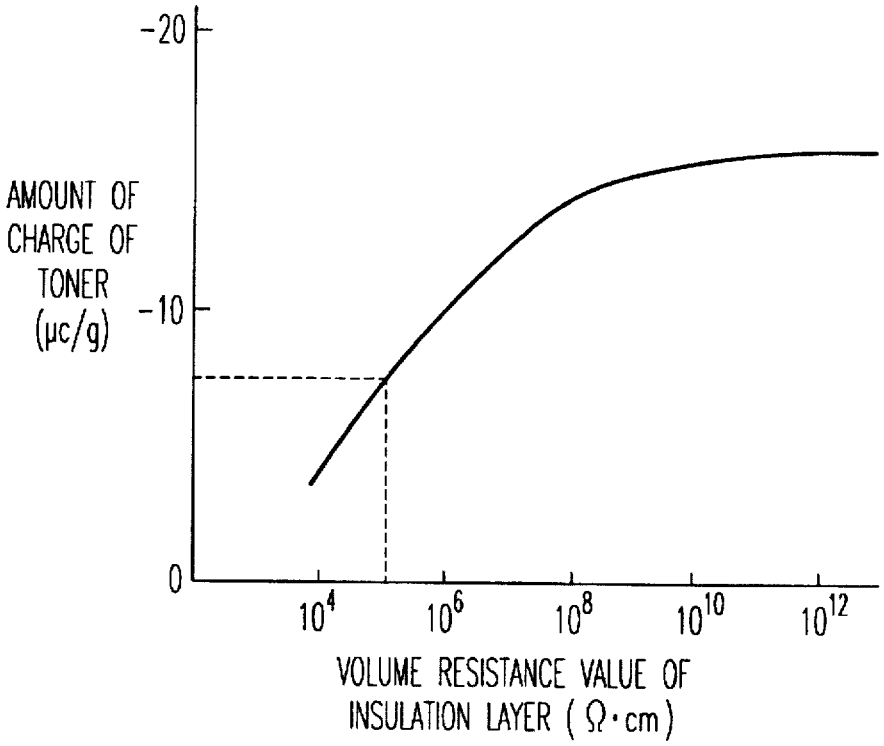
FIG. 7 is a characteristic diagram showing a relationship between a volume resistance value and an amount of charge of the toner in the insulation layer in an embodiment according to the present invention.

FIG. 7 is a characteristic diagram showing the relationship between the volume resistance value and the quantity of charged toner in the insulation layer of this embodiment. As shown, the volume resistance value $R_{V1}$ of the insulation layer 23b and the quantity of charged toner on the insulation layer 23b can be increased.

In this embodiment, the insulation layer 23b is adapted to have the volume resistance value $R_{V1}$ of $10^5$ Ω·cm by limiting the dose of the magnetic material to the insulation layer 23b. Thus the toner T can be charged by friction so that the amount of static charge which can ensure normal development of the static latent image is supplied. In addition, the apparatus is adapted so that the volume resistance value $R_{V1}$ is smaller than the volume resistance value $R_{V2}$ as described above and therefore the current is prevented from leaking through the first toner transfer roller 23 to the second toner transfer roller 14 when the bias voltages F1 and F2, and the potential difference between the first toner transfer roller 23 and the second toner transfer roller 14 can be certainly maintained at the preset value and therefore the toner T can be certainly transferred from the first toner transfer roller 23 to the second toner transfer roller 14.

Figure 4:
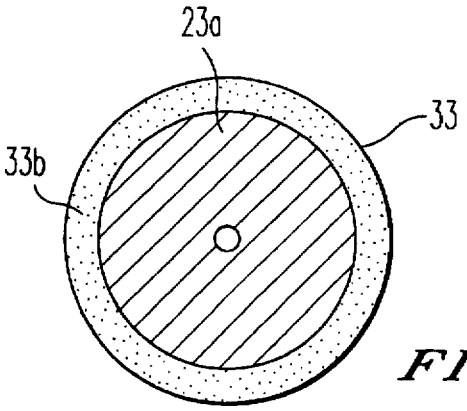
FIG. 4 is a configuration diagram showing another embodiment of the first toner transfer roller in an embodiment according to the present invention.

FIG. 4 is a configuration diagram showing another example of the first toner transfer roller in this embodiment. 33 is a first toner transfer roller which is the first developer transfer means. The first toner transfer roller 33 comprises a core 23a supported to be rotatable and a sheet type insulation layer 33b wound around the outer periphery of the core 23a. The insulation layer 33b is made of a resin in which magnetic material having a specified particle size is uniformly dispersed and the magnetic material is formed with a ferromagnetic substance such as a magnet and magnetized in advance.

The insulation layer 33b shown in FIG. 4 differs from the insulation layer 23b shown in FIG. 2 in that a resin is used instead of elastic rubber as a material for the base in which magnetic material is dispersed, and the weight percentage and the particle size of the magnetic material and the thickness and the volume resistance value of the insulation layer 33b are the same as those of the insulation layer 23b.

Since the resin is used as the base material of the insulation layer 33b, the effect for preventing deformation of the elastic layer 14a of the second toner transfer roller 14 slightly deteriorates as compared an elastic rubber but the wear resistance of the insulation layer 33b can be improved, thereby extending the service life of the first toner transfer roller 33 and maintenance of the developing apparatus 20 can be easier. Operation and effects of this embodiment other than the above are same in the first toner transfer roller 23 and the first toner transfer roller 23.

As described above, according to the first mean of the present invention, the magnetism which is made act on the one-component developer by the first developer transfer means is restrained from being attenuated by the effect of the insulation layer by making the first developer transfer means act the magnetism on the one-component developer through the insulation layer in which the magnetic material is dispersed or the magnetic material in the insulation layer act the magnetism on the one-component developer and therefore the one-component developer can be sufficiently attracted by the first developer transfer means and abnormal development such as lowering of the density of the toner image due to insufficient supply of the one-component developer can be prevented.

What is claimed is:

1. A developing apparatus comprising first developer transfer means for attracting and transferring a developer, developer control means for thinning the developer on said first developer transfer means and charging said developer by friction, second developer transfer means for attracting the developer, which is friction-charged by said developer control means on said first developer transfer means, at a contact position with the first developer transfer means, transferring the developer onto a photoreceptor for electronic photography at a developing position and developing a static latent image, and a bias power supply for applying a bias voltage at least to the first developer transfer means and the second developer transfer means and generating a static power which makes the developer on the first developer transfer means attracted at said contact position by the second developer transfer means, said first developer transfer means being provided with an insulation layer, wherein a volume resistance value at a position near a surface layer of said second developer transfer means is larger than a volume resistance value of said insulation layer.

2. A developing apparatus according to claim 1, wherein said insulating layer has a magnetic material which is formed with ferromagnetic substance and magnetized.

3. A developing apparatus according to claim 1, wherein said insulation layer is formed with elastic rubber and a magnetic material.

4. A developing apparatus according to claim 1, wherein said insulation layer is formed with a resin and a magnetic material.

5. A developing apparatus according to claim 1, wherein said insulation layer contains a magnetic material of 50 wt % or over.

6. A developing apparatus according to claim 1, wherein said insulating layer has a magnetic material having a particle size of $10^{-11}$ m or over and $10^{-4}$ m or under.

7. A developing apparatus according to claim 1, wherein a thickness of said insulation layer is set to 0.3 mm or over.

8. A developing apparatus according to claim 1, wherein said insulation layer is adapted so that the volume resistance value thereof is 105 Ω·cm or over.

9. A developing apparatus according to claim 1 in which the developer is a one-component developer.

10. The developing apparatus according to claim 1 wherein a magnetic material is dispersed at least near a surface of the insulation layer provided on said first developer transfer means.

* * * * *